US009016798B2

(12) United States Patent
Berning et al.

(10) Patent No.: US 9,016,798 B2
(45) Date of Patent: Apr. 28, 2015

(54) SELF-PROPELLED CONSTRUCTION MACHINE

(71) Applicant: Wirtgen GmbH, Windhagen (DE)

(72) Inventors: Christian Berning, Brühl (DE); Hanjo Held, Windhagen (DE); Philip Verhaelen, Köln (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 14 days.

(21) Appl. No.: 13/788,962

(22) Filed: Mar. 7, 2013

(65) Prior Publication Data

US 2014/0035343 A1 Feb. 6, 2014

(30) Foreign Application Priority Data

Aug. 6, 2012 (DE) ..... 10 2012 015 346

(51) Int. Cl.
*E01C 23/12* (2006.01)
*E01C 23/088* (2006.01)
*E21C 25/06* (2006.01)

(52) U.S. Cl.
CPC ..... *E01C 23/088* (2013.01); *E01C 23/127* (2013.01); *E21C 25/06* (2013.01)

(58) Field of Classification Search
CPC ..... E01C 23/127; E02F 3/783
USPC ..... 299/1.5, 39.1, 39.2, 39.4, 39.6
See application file for complete search history.

(56) References Cited

U.S. PATENT DOCUMENTS 4,723,867 A 2/1988 Wirtgen
5,315,770 A 5/1994 Campbell (Continued)

FOREIGN PATENT DOCUMENTS

DE 102006024123 A1 11/2007
DE 102007044090 A1 4/2009

(Continued)

OTHER PUBLICATIONS

Co-pending U.S. Appl. No. 13/788,897, filed Mar. 7, 2013 (not prior art).

(Continued)

*Primary Examiner* — David Bagnell
*Assistant Examiner* — Michael Goodwin
(74) *Attorney, Agent, or Firm* — Patterson Intellectual Property Law, PC; Lucian Wayne Beavers

(57) ABSTRACT

A self-propelled construction machine has a machine frame and an operating drum for processing the ground surface, wherein the operating drum is positioned in a downwards open drum housing, that is closed on both sides by an edge protector, which is adjustable in height by an actuator for raising and/or lowering the edge protector. A control unit comprises a sensor for registering the distance a between a reference point on the edge protector and the ground surface. Furthermore, the control unit is configured so that when the distance between reference point and ground surface falls below a predetermined minimum distance, the actuator is switched from a floating setting, so that the edge protector is raised. As a result, the edge protector tightly closes the drum housing at the sides without there being a risk that the edge protector can be entrenched in loose substrate.

16 Claims, 6 Drawing Sheets

(56) References Cited

U.S. PATENT DOCUMENTS

| | | | | |
|---|---|---|---|---|
| 5,378,081 | A * | 1/1995 | Swisher, Jr. | 299/39.5 |
| 7,530,641 | B2 | 5/2009 | Berning et al. | |
| 7,887,142 | B2 * | 2/2011 | Hall et al. | 299/1.5 |
| 8,047,741 | B2 | 11/2011 | Von Schonebeck et al. | |
| 8,246,270 | B2 | 8/2012 | Berning et al. | |
| 2002/0047301 | A1 * | 4/2002 | Davis | 299/1.5 |
| 2008/0153402 | A1 * | 6/2008 | Arcona et al. | 451/352 |
| 2009/0108663 | A1 * | 4/2009 | Berning et al. | 299/1.5 |
| 2009/0232598 | A1 | 9/2009 | Cochran et al. | |
| 2012/0286558 | A1 | 11/2012 | Berning et al. | |

FOREIGN PATENT DOCUMENTS

| | | | |
|---|---|---|---|
| DE | 102010014529 | A1 | 10/2011 |
| EP | 1936034 | A2 | 6/2008 |
| EP | 2050875 | A2 | 4/2009 |
| EP | 2374937 | A2 | 10/2011 |

OTHER PUBLICATIONS

European Search Report in corresponding European Patent Application No. EP 13 00 3912, dated Oct. 31, 2013, 2 pp. (not prior art).

* cited by examiner

SELF-PROPELLED CONSTRUCTION MACHINE

BACKGROUND OF THE INVENTION

1. Field of the Invention

The invention relates to a self-propelled construction machine, in particular road milling machine, stabiliser, recycler or surface miner, with a machine frame and an operating drum, wherein the operating drum is positioned in a downwards open drum housing that is closed on both sides by edge protectors adjustable in height. The invention further relates to a method for operating such a construction machine.

2. Description of the Prior Art

The above-mentioned construction machines have a rotating operating drum for processing of ground material, which can be a milling or cutting drum. With the operating drum, for example, damaged pavement layers can be removed, existing road surfaces can be recycled, the land for road construction can be prepared, or mineral resources can be mined.

The operating drum of the known self-propelled construction machines is positioned in a downwards open drum housing, that is closed by a hold-down device positioned in front of the operating drum, when seen in the operating direction, and a stripper positioned behind the drum, when seen in the operating direction. Plates extending in the operating direction, which are referred to as edge protectors, close the drum housing at the sides.

The edge protector of the known self-propelled construction machines is adjustable in height. A mechanism for raising and/or lowering the edge protector is provided for the purpose. The edge protector can be lowered solely under the action of the weight of the edge protector or can be supplemented by additional applied force. In both cases, the edge protector exerts pressure on the ground surface. While doing so, the edge protector stands with its lower edge on the ground surface.

The mechanism for raising and/or lowering the edge protector is actuated by the machine driver, especially when it is necessary to have access to the operating drum. During operation of the construction machine, however, the edge protector is always lowered. Therefore self-propelled construction machines have a circuit which does not permit the edge protector to be fixed in the raised position. Operation of the machine is characterised by a floating mounting of the edge protector, with which the edge protector rests on the ground with a defined contact force.

During operation of the construction machine, in particular on loose substrate, there is the problem that the edge protector becomes entrenched in the ground. From increased traction resistance and hence higher fuel consumption and wear, this can lead to complete stoppage of the machine.

SUMMARY OF THE INVENTION

The object of the invention is to provide a self-propelled construction machine, in particular road milling machine, stabiliser, recycler or surface miner, in which there is no risk of the edge protector becoming entrenched in loose substrate and which enables user-friendly and ergonomic operation. A further object of the invention is to specify a method with which a self-propelled construction machine can be operated in a user-friendly and ergonomic manner and without the risk of entrenchment of the edge protector in loose substrate.

These objects are achieved according to the invention with the features of the independent patent claims. The subjects of the dependent claims relate to preferred embodiments of the invention.

The construction machine in accordance with the invention has a mechanism for raising and/or lowering the edge protector which provides a floating setting in which the edge protector has a floating mounting, so that edge protector can automatically adjust its height. As a result of this, the edge protector can follow the surface of the terrain during operation of the machine. During operation of the machine, the mechanism for raising and/or lowering is basically in the floating setting.

The construction machine in accordance with the invention furthermore has a control unit for the mechanism for raising and/or lowering the edge protector, which comprises means for detecting the distance between a reference point on the edge protector and the ground surface and means for controlling the mechanism for raising and/or lowering the edge protector. The control unit is configured so that, when the distance between reference point and ground surface falls below a predetermined minimum distance, the mechanism for raising and/or lowering the edge protector is switched from the floating setting, so that the edge protector is raised. The predetermined minimum distance between reference point and ground surface should be calculated so that the edge protector rests on the ground surface and tightly closes the drum housing at the side. The control unit in accordance with the invention effectively prevents the edge protection becoming entrenched into loose ground under its own weight or due to an additional downwards force which can be exerted on the edge protector.

A preferred embodiment of the invention provides that the control unit is configured so that, when a predetermined minimum distance between reference point and ground surface is reached or exceeded, the mechanism for raising and/or lowering the edge protector is actuated, so that it returns to the floating setting.

The automatic control of the edge protector gives the machine driver the critical advantage that he does not constantly have to monitor the height of the edge protector during operation, and also does not need to correct it. This is an advantage in so far as the height of the edge protector can only be assessed with difficulty from the driver's platform and, in any case, entrenchment of the edge protector cannot be detected.

A particularly preferred embodiment of the invention provides that the means for registering the distance between reference point and ground surface comprises a probe element for sensing the ground surface. The probe element is fastened on the edge protector so that the probe element is deflected when the distance between reference point and ground surface is below the predetermined minimum. In a particularly preferred embodiment, the means for actuating the mechanism for raising and/or lowering the edge protector comprises a sensor, with which the deflection of the probe element is registered when the edge protector becomes entrenched in the ground surface. The sensor for registering the deflection of the probe element is preferably a proximity switch, which operates contactlessly, to minimise the risk of malfunctions.

The control system for the device for raising and/or lowering the edge protector preferably provides for a switching hysteresis, so that the edge protector is only actuated when the height exceeds or falls below the respective reference values by a predetermined amount. This switching hysteresis can be achieved when the lower edge of the probe element is not flush with the lower edge of the edge protector, but is positioned above the lower edge of the edge protector by a predetermined amount. Alternatively, switching hysteresis can also be implemented in the control unit.

The probe element for sensing the ground surface is preferably configured as a resilient probe element, which can yield on impact with obstacles. However, the probe element can also be rigidly configured. With a rigid configuration of the probe element, the probe element can have an articulated or resilient mounting.

In a particularly preferred embodiment, the probe element comprises a helical tension spring, whose spring wire continues at the end of the spring into a rod-shaped section, which is bent round in relation to the axis of the spring. Preferably, the spring wire of the helical spring continues into the rod-shaped section to form a bent section projecting beyond the diameter of the spring which extends into a direction opposite to the rod-shaped section. This section extending in the opposite direction, preferably forms part of the probe element that is registered by the proximity switch. A deflection of the probe element results in the distance of this section from the proximity switch decreasing or increasing.

Optical sensors or conventional mechanical switching contacts, with which the deflection of the probe element is detected, can be provided instead of a preferably inductive or capacitive proximity switch.

For the invention, it is unimportant how the mechanism for raising and/or lowering the edge protector is configured. For example, only one mechanism can be provided for lifting a loosely guided or suspended edge protector, which rests on the ground surface due to its weight, so that the edge protector has a floating mounting. In a preferred embodiment, the mechanism for raising and/or lowering the edge protector comprises at least one piston/cylinder arrangement, wherein the cylinder has an articulated connection to the machine frame and the piston has an articulated connection to the edge protector, or the cylinder has an articulated connection to the edge protector and the piston has an articulated connection to the machine frame. This piston/cylinder arrangement is controlled so that the edge protector has a floating mounting.

The helical tension spring is preferably positioned on the edge protector so that the rod-shaped section extends along a long side of the edge protector. It is thereby possible to place the rod-shaped section on one side or the other of the edge protector. For example, the rod-shaped section can be put on the inner side of the edge protector, to allow it to travel, flush with the edge protector, along an obstacle, which the rod-shaped section could otherwise strike.

Where the mechanism for raising and/or lowering the edge protector is controlled hydraulically, the probe element can be configured as an actuating element of a hydraulic valve for controlling the piston/cylinder arrangement of the mechanism for raising and/or lowering the edge protector.

A further alternative embodiment of the invention provides that the means for detecting the distance between reference point and ground surface comprises a contactlessly measuring sensor. For example, the sensor can be an ultrasonic sensor.

BRIEF DESCRIPTION OF THE DRAWINGS

In the following, examples of embodiments of the invention are described in more detail with reference to the figures.

These show.

DETAILED DESCRIPTION

Figure 1:
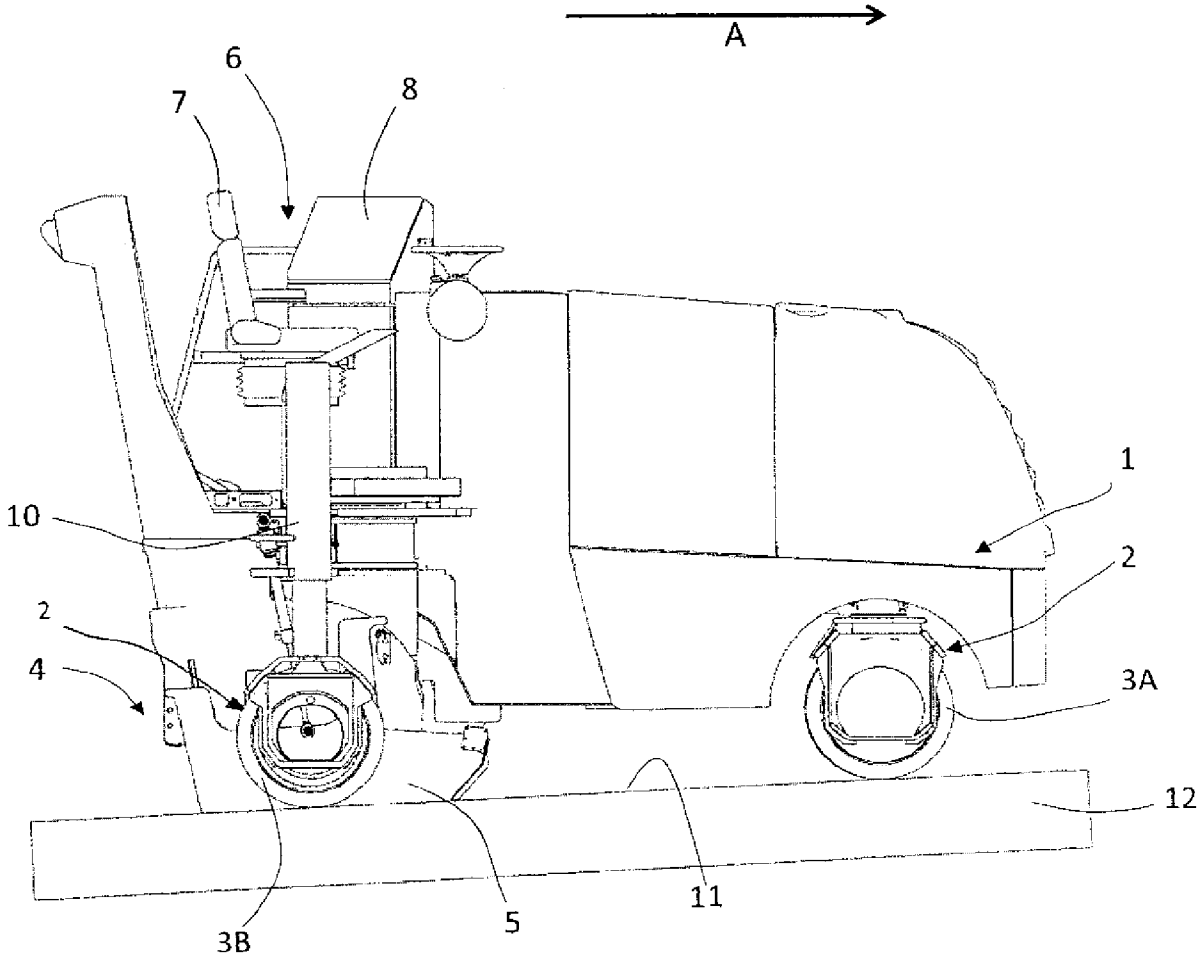
FIG. 1 a road milling machine in side view.

FIG. 1 shows in a side view an embodiment of a road milling machine, specifically a small milling machine. The road milling machine has a machine frame 1, which is supported by a chassis 2. The chassis 2 has a front wheel 3A and two rear wheels 3B. In FIG. 1, only the right-hand rear wheel 3B, when seen in the operating direction, is visible. In the known construction machines, the chassis can also have crawler tracks instead of wheels.

The milling machine has an operating drum, specifically a milling drum. The milling drum, which is not visible in FIG. 1, is located in a drum housing 4. The milling drum housing 4 is closed on left and right sides in the operating direction A by an edge protector 5. Only the right-hand edge protector 5, when seen in the operating direction A, is visible in FIG. 1. The driver's platform 6 is positioned above the milling drum housing, with a driver's seat 7 and the control panel 8. The machine frame 1 of the road milling machine can be adjusted in height on lifting columns 10 relative to the surface 11 of the ground.

Figure 2:
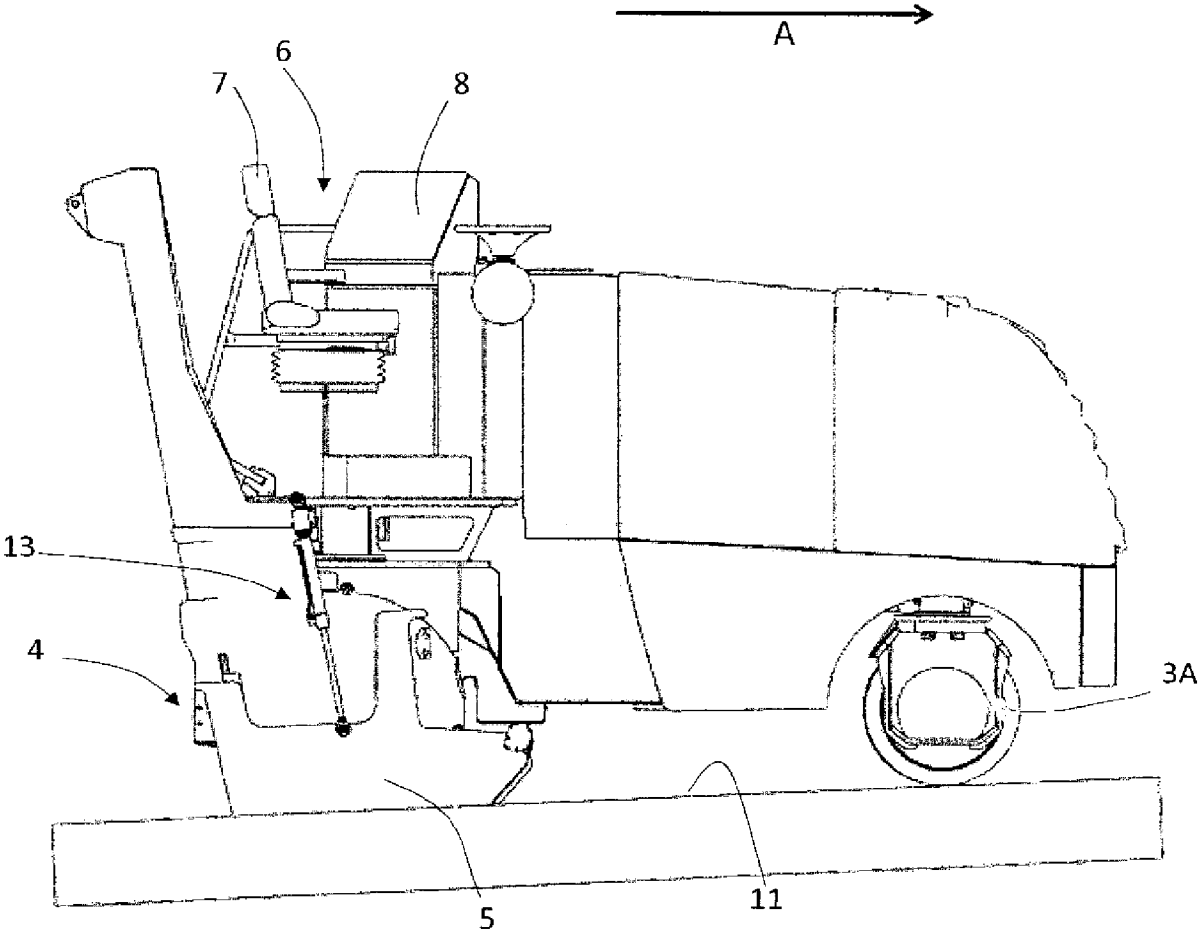
FIG. 2 a view of the road milling machine of FIG. 1, wherein the edge protector is exposed, FIG. 3 the mechanism for raising and/or lowering the edge protector, together with the edge protector of the road milling machine of FIG. 1, FIG. 4 the section IV of FIG. 3 in enlarged, partially sectioned view, FIG. 5 the view of FIG. 4 from the direction of arrow V in enlarged representation, FIG. 6 an alternative embodiment of the control unit for the mechanism for raising and/or lowering the edge protector, FIG. 7 a further alternative embodiment of the control unit and FIG. 8 a further alternative embodiment of the control unit, together with the edge protector.

FIG. 2 shows a view of the milling machine, wherein the rear right-hand wheel 3B and the rear right-hand lifting column 10 are not shown, so that the right-hand edge protector 5 is exposed.

The edge protector 5 is formed by a metal plate which extends in the operating direction A. Since the left-hand and right-hand edge protectors have the same structure, only the right-hand edge protector 5 is described in the following, with reference to FIG. 3.

The edge protector 5 can be adjusted in height, in relation to the ground surface, between two stops (not shown). The edge protector 5 is mounted so that it can swing easily between the stops. The height of the edge protector 5 is adjusted by a mechanism 13, which comprises a piston/cylinder arrangement 14, whose cylinder 14A has an articulated mounting on the machine frame 1 and whose piston 14B has an articulated connection to the edge protector 5. The mechanism 13 may also be referred to as an actuator 13. The edge protector 5 can be raised or lowered by retraction and extension of the piston 14B of the piston/cylinder arrangement 14. The piston/cylinder arrangement 13 is actuated by a hydraulic unit 15, which is only shown schematically in FIG. 3. The components required for this purpose, such as hydraulic lines, hydraulic valves etc. are known to the person skilled in the art.

The mechanism 13 for raising and/or lowering the edge protector 5 provides a floating setting, in which the edge protector is supported or suspended so that the edge protector 5 is drawn over the ground during the forward motion of the construction machine, wherein the edge protector 5 always has the tendency to drop down. As a result, the edge protector rests on the surface of the ground 11 with a defined contact force, which can correspond to the weight of the edge protector or can be greater or smaller than the weight force. The hydraulic unit 15 is configured for this purpose, so that the edge protector drops slowly until the edge protector rests on the ground surface with the defined contact force in a floating mode. Thus the milling drum housing 4 always remains tightly closed at the sides. However, the mechanism 13 for raising and/or lowering the edge protector can also be operated so that the piston-cylinder arrangement raises the edge protector.

The control unit 16 for the mechanism for raising and/or lowering the edge protector is described in detail in the following.

The control unit 16 comprises means with which the distance a between a reference point R of the edge protector 5 and the ground surface 11 can be registered. Furthermore, the control unit 16 comprises means for controlling the mechanism 13 for raising and/or lowering the edge protector as a function of the distance a between reference point 12 and ground surface 11.

Figure 4:
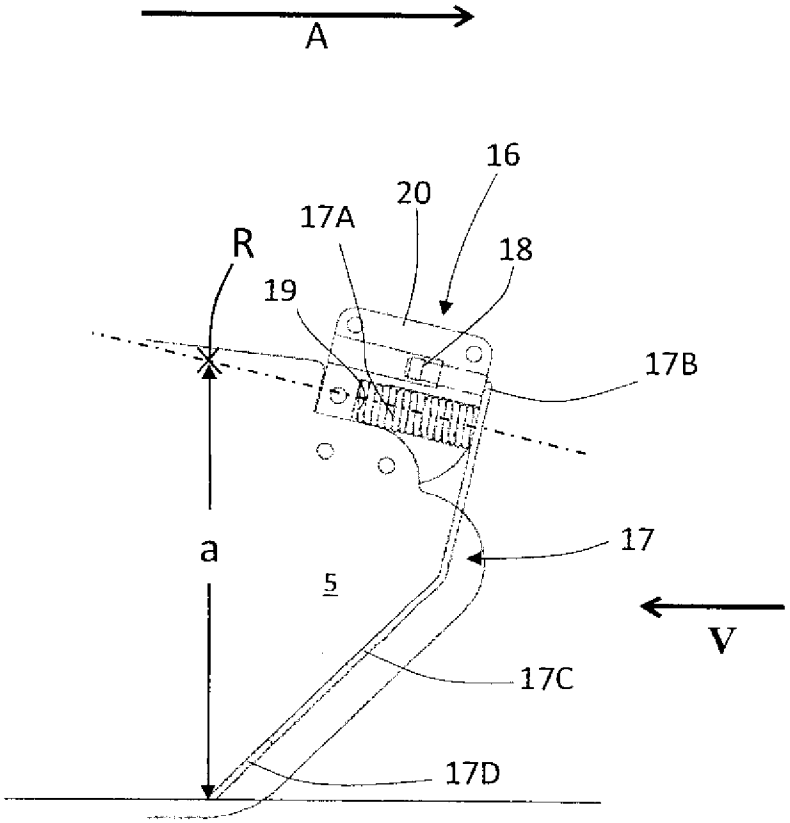
Figure 5:
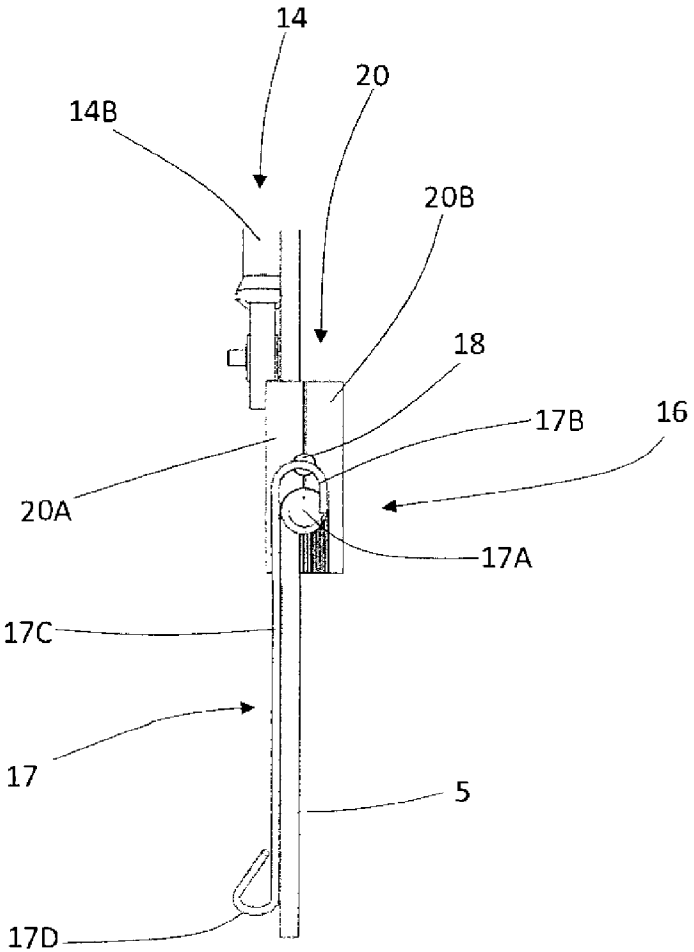

In a first embodiment, the means described above comprise a resilient probe element 17 and a preferably inductive or capacitive proximity switch 18 (FIG. 4). The resilient probe element 17 comprises a helical tension spring 17A. The spring wire of the helical tension spring 17A is bent at one end to form a semicircular section 17B, wherein the semicircular section 17B continues into a rod-shaped section 17C, which extends in a direction opposite to the semicircular section 17B (FIG. 5). The free end of the rod-shaped section 17C is bent. The probe element 17 senses the ground surface 11 with the bent end 17D. The probe element 17 is positioned on the upper front end of the edge protector 5, wherein the rod-shaped section 17C of the probe element follows the forward contour of the edge protector. For this purpose, the rod-shaped section 17C is kinked between the ends.

The helical tension spring 17A of the probe element 17 is located in a cylindrical bore 19 of a housing 20, which is fastened to the upper of the edge protector 5. The housing 20 consists of two half-housings 20A and 20B, between which the helical tension spring 17A of the probe element 17 is held clamped. The inductive or capacitive proximity switch 18 is positioned above the helical tension spring 17A in the housing 20. The proximity switch 18 is located so that the sensitive portion is facing the bent section 17B of the probe element.

During operation of the milling machine, the edge protector is drawn over the ground due to the floating mounting, wherein the probe element 17 slides with the bent end portion 17D on or just above the ground surface 11. In doing so, a predetermined distance a is defined between the reference point R and the ground surface 11. If the edge protector 5 becomes entrenched in the ground, the distance a between reference point and ground surface decreases, so that the probe element 17 is deflected against the direction of operation A. As a result, the distance between the bent section 17B of the probe element 17 and the proximity switch 18 increases, so that the proximity switch is actuated, for example is closed.

The proximity switch 18, which is connected to the control system of the hydraulic unit 15 by means of a line (not shown), which can be run along the upper edge of the edge protector, now actuates the hydraulic unit 15 of the piston/cylinder arrangement 14, so that the piston 14B is retracted and the edge protector 5 is raised. The edge protector 5 remains raised until the predetermined minimum distance a is regained or exceeded, so that the probe element 17 returns to its initial position, in which the proximity switch is not actuated, for example is open. Consequently, the lower edge of the edge protector is again at the level of the ground surface. When the proximity switch is not actuated, for example is open, the floating setting is restored, so that the edge protector is drawn over the ground surface again with the defined contact force. This contact force should be specified so that the edge protector does not become entrenched with a sufficiently hard substrate.

Figure 3:
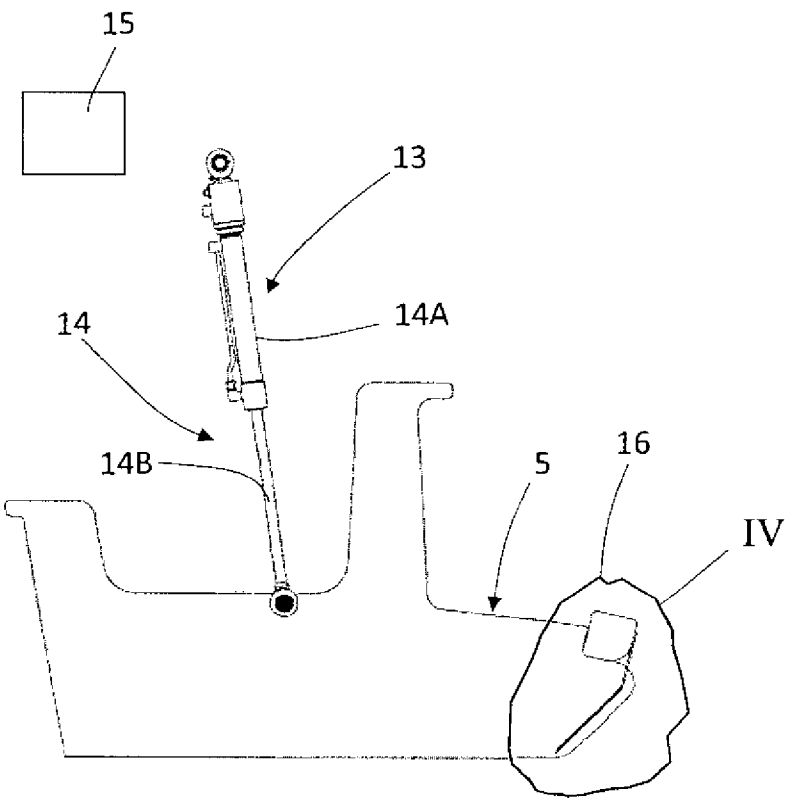
Figure 6:
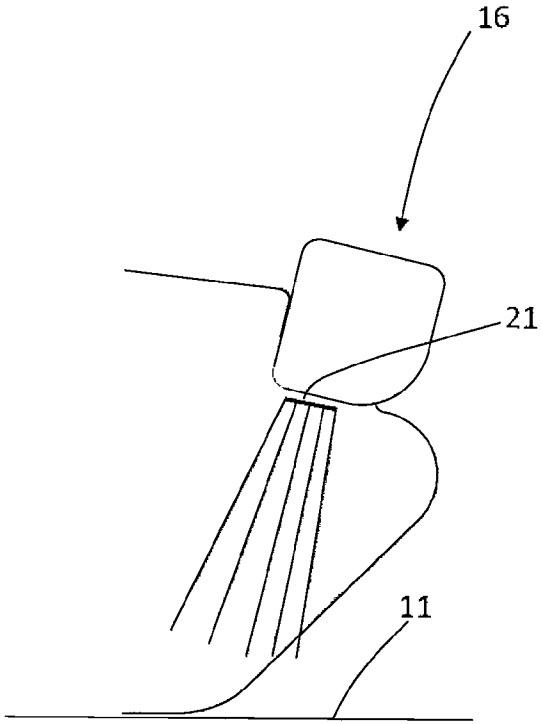

FIG. 6 shows an alternative embodiment of the control unit 16, which differs from the embodiment described with reference to FIGS. 3 and 4 in that, instead of a mechanical probe element, a contactless distance measurement is provided, for example by means of an ultrasonic sensor 21, for registering the distance a between the reference point R and the ground surface 11. Processing of the distance signal of the ultrasonic sensor is part of the state of the art.

Figure 7:
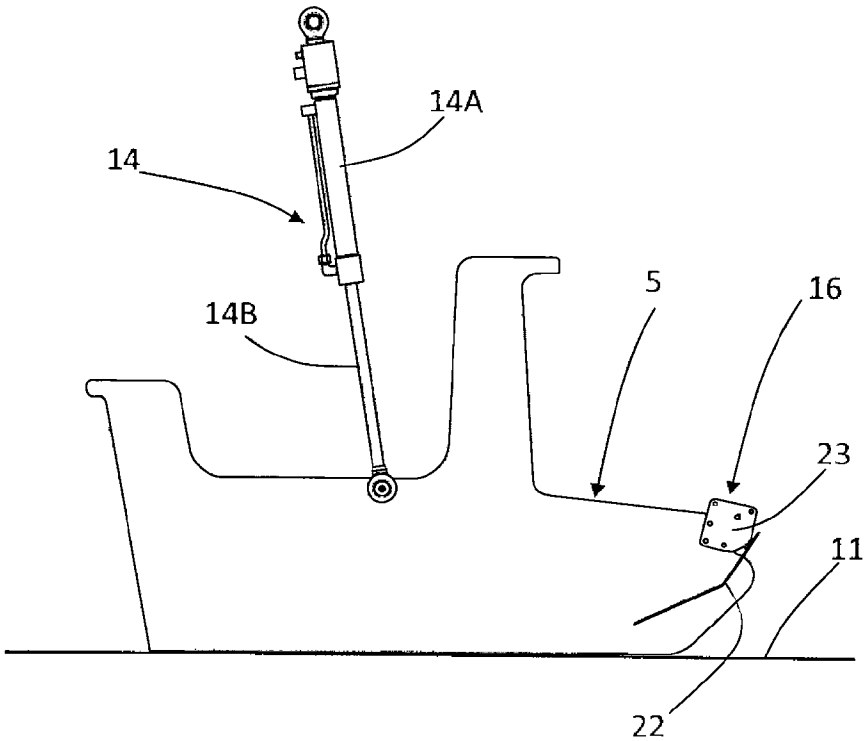

FIG. 7 shows a further alternative embodiment of the control unit 16. In this embodiment, the probe element is an actuating element 22 of a hydraulic valve 23, which is only represented schematically in FIG. 7. The hydraulic valve 23 is a valve of the hydraulic unit 15, with which the piston/cylinder arrangement 14 is controlled. By actuation of the hydraulic valve 23 as a result of a deflection of the actuating element 22, the piston 14B of the piston/cylinder arrangement 14 is retracted, so that the edge protector 5 is raised.

Figure 8:
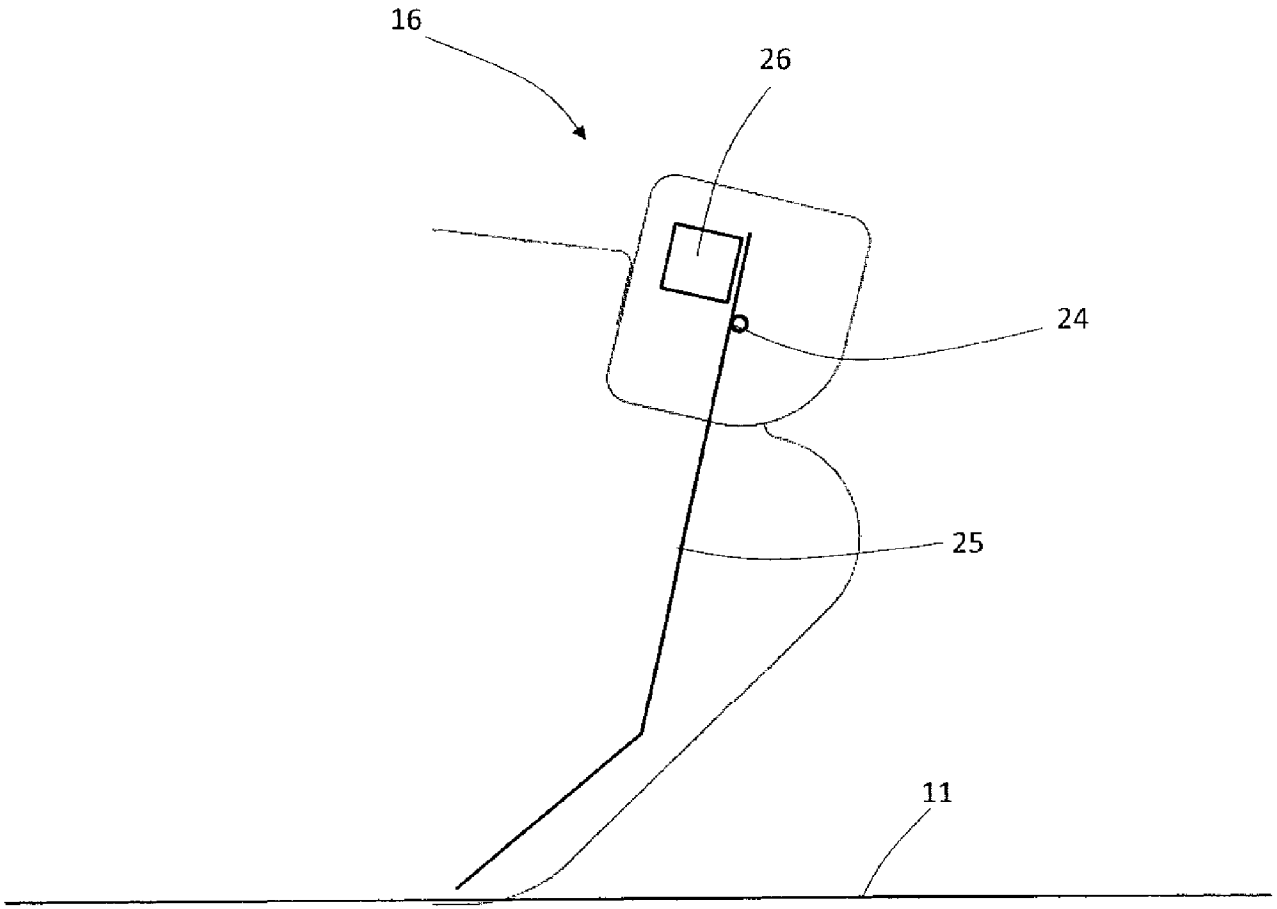

FIG. 8 shows a further alternative embodiment of the control unit 16, in schematic representation, which has a rigid probe element 25 with an articulated mounting on a pivot 24, which is resiliently pre-loaded on the ground surface 11. The deflection of the probe element 25 is registered by a switch 26, shown only schematically. Alternatively, the pivoting position of the probe element can also be registered by a rotary position transducer or similar, wherein a control signal proportional to the distance between reference point and ground surface is generated.

What is claimed is:

1. A self-propelled construction machine, comprising:

a machine frame;

an operating drum for processing a ground surface;

a downwardly open drum housing supported from the machine frame and having the operating drum positioned in the housing, the housing including an edge protector on at least one side of the housing;

an actuator connected to the edge protector and configured to raise and lower the edge protector, the actuator including a floating setting in which the edge protector has a floating mounting, so that a height of the edge protector can be automatically adjusted; and a control unit including a sensor configured to detect a distance between a reference point on the edge protector and the ground surface, the control unit being configured such that when the distance is less than a predetermined minimum distance the actuator is actuated to raise the edge protector.

2. The self-propelled construction machine of claim 1, wherein:

the control unit is configured such that when the distance is equal to or greater than the predetermined minimum distance, the actuator is returned to the floating setting.

3. The self-propelled construction machine of claim 1, wherein:

the sensor includes a probe element configured to engage the ground surface, the probe element being attached to the edge protector so that when the distance between the reference point and the ground surface is less than the predetermined minimum distance the probe element is deflected.

4. The self-propelled construction machine of claim 3, wherein:

the sensor is configured to register the deflection of the probe element when the edge protector becomes entrenched in a substrate below the ground surface.

5. The self-propelled construction machine of claim 4, wherein:

the sensor comprises a proximity switch.

6. The self-propelled construction machine of claim 3, wherein:

the probe element is a resilient probe element.

7. The self-propelled construction machine of claim 6, wherein:

the resilient probe element comprises a helical tension spring including a spring wire continuing from an end of the helical tension spring into a rod-shaped section.

8. The self-propelled construction machine of claim 7, wherein:

the spring wire includes a bent section extending in a direction opposite to the rod-shaped section.

9. The self-propelled construction machine of claim 7, wherein:

the helical tension spring is positioned on the edge protector so that the rod-shaped section follows a forward contour of the edge protector.

10. The self-propelled construction machine of claim 3, wherein:

the sensor includes a hydraulic valve connected to the probe element such that the hydraulic valve is operated upon deflection of the probe element; and the actuator is a hydraulic actuator connected to the hydraulic valve.

11. The self-propelled construction machine of claim 1, wherein:

the sensor comprises a contactless sensor that does not contact the ground surface.

12. The self-propelled construction machine of claim 11, wherein:

the contactless sensor is an ultrasonic sensor.

13. A method of operating a self-propelled construction machine, the machine including an operating drum positioned in a drum housing, the drum housing being closed at at least one side by an edge protector, the edge protector being adjustable in height and having a floating mounting mode such that a height of the edge protector can be automatically adjusted, the method comprising:

(a) detecting a distance between a reference point on the edge protector and a ground surface; and (b) raising the edge protector when the distance is less than a predetermined minimum distance.

14. The method of claim 13, further comprising:

after step (b), returning the edge protector to the floating mounting mode when the distance between the reference point and the ground surface reaches or exceeds the predetermined minimum distance.

15. The method of claim 13, wherein:

step (a) comprises scanning the ground surface with a contactless sensor.

16. The method of claim 13, wherein:

step (a) comprises engaging the ground surface with a probe element.

* * * * *